US005893677A

United States Patent [19]

Haehn et al.

[11] Patent Number: 5,893,677

[45] Date of Patent: Apr. 13, 1999

[54] ROADWORKING MACHINE

[75] Inventors: Guenter Haehn, Koenigswinter; Dieter Simons, Buchholz; Peter Busley, Willroth, all of Germany

[73] Assignee: Wirtgen GmbH, Germany

[21] Appl. No.: 08/875,992

[22] PCT Filed: Feb. 9, 1996

[86] PCT No.: PCT/EP96/00556

§ 371 Date: Nov. 7, 1997

§ 102(e) Date: Nov. 7, 1997

[87] PCT Pub. No.: WO96/24725

PCT Pub. Date: Aug. 15, 1996

[30] Foreign Application Priority Data

Feb. 12, 1995 [DE] Germany ..... 19504495

[51] Int. Cl.[6] ..... E01C 23/08; E21C 47/00

[52] U.S. Cl. ..... 404/90; 404/92; 299/39.4; 299/39.6

[58] Field of Search ..... 404/90, 91, 92; 299/39.4, 39.6, 76

[56] References Cited

U.S. PATENT DOCUMENTS

| | | | |
|---|---|---|---|
| 3,732,023 | 5/1973 | Rank et al. | 404/92 X |
| 4,637,753 | 1/1987 | Swisher, Jr. | 404/90 |
| 4,946,307 | 8/1990 | Jakob | 404/90 X |
| 5,190,398 | 3/1993 | Swisher, Jr. | 299/39.4 X |
| 5,259,692 | 11/1993 | Beller et al. | 299/39.4 X |
| 5,354,146 | 10/1994 | O'konek | 299/39.4 X |
| 5,354,147 | 10/1994 | Swisher, Jr. | 299/39.6 |

*Primary Examiner*—David J. Bagnell
*Assistant Examiner*—Sunil Singh
*Attorney, Agent, or Firm*—Knechtel, Demeur & Samlan

[57] ABSTRACT

In a machine used to refurbish roads, having a driver's cab for one operator, an automotive running gear with two axles (4) and a working roller (8) that is mounted to pivot relative to the machine frame and that is enclosed in a hood (7) which defines a working chamber, and having a drive motor (9) with the necessary output to drive the working roller (8) and to power the vehicle's travel, the invention provides that a drive unit containing the working motor (9) is mounted in a pivoting frame (13) and forms a unit (2) that can be pivoted relative to the machine frame (1), that the working roller (8) is also mounted in the pivotable unit (2) and, together with the latter (2), can be pivoted relative to the hood (7), which has a fixed mounting to the machine frame (1), and that the working roller (8) is directly weighted by the unit (2), virtually the entire machine weight being concentrated between the running gear axles (4) and transferred to the pivotable unit (2).

19 Claims, 5 Drawing Sheets

ROADWORKING MACHINE

BACKGROUND OF THE INVENTION

The present invention is directed to an automotive working machine for the treatment of roadways.

Such working machines are used for the treatment of road material, e.g., for stabilization of ground having insufficient bearing properties, the fragmentation of hard asphalt surfacing, and for the recycling of bound or non-bound road surfaces.

Known machines of the above type are characterized by usually one working drum rotating in a working chamber and being arranged to have its height and inclination adjusted in conformity with the surface to be treated.

The required processes, e.g. the breaking and fragmenting of the milled-off road material, the adding of binding agents, the mixing and distributing of added materials and the like, will take place in said working chamber.

The inventive working process can also be divided into a counter-rotational working process and a co-rotational working process, depending on whether—with the same rotational direction—the peripheral force of the working drum will act against the driving force of the machine or will support it. Because of their relatively wide range of applications, especially in working processes wherein binding agents such as lime or cement are mixed partly in loose form with the surface layer to be treated, such machine are often provided with a closed driver's cabin so as to comply with working safety requirements.

The above described working machines for the refurbishing of roadways comprise a working drum driven either on one or both sides, and a very high drive power may be required depending on the respective application, with the rotational speed of the working drum being adjustable. Since the working process is often performed in the immediate vicinity of lateral obstacles, e.g. embankments, curbs, trees, house walls and so on, difficulties often occur because the slightest possible distance has to be kept between the outer cutting edge of the working drum and the outer edge of the machine in the working range.

The working chamber, extending between the working drum and the outer cover, is of special importance for the result of the working process. The work achieved could be improved, e.g., by an enlarged working chamber having a larger working depth. In known machines, the positions of the working drum axis relative to the drive carriage axes are quite different. Extensive research has revealed that the position of the working drum axis relative to the drive carriage axis is of particular relevance for the detachment behavior. The working machines, usually provided with two drive carriage axes, require considerable pressing forces to obtain the detachment behavior of the working drum, the maximum possible pressing force being determined by the weight of the machine. The arrangement of the working drum is favorable when, if feasible, the whole machine weight can be used in counter-rotational and co-rotational working processes for generating the possibly required pressing forces of the working drum. The outer cover is fixedly arranged on the machine frame. The fixed arrangement is usually advantageous because of its low constructional expenditure (no necessity for guide elements). For the working result, the particle size and resp. the particle distribution of the detached and resp. also picked-up material is of eminent importance. The distribution of the particle sizes is decisively influenced by the geometrical configuration of the working chamber which is determined by defined geometrical relationships between the working drum and the outer cover. Particularly an outer cover which is resistant to mechanical stresses will provide advantageous working results.

The driver's platform, which for safety reasons is imperative in machines of the above type, poses problems due to the resultant increased height of the machine, which is disadvantageous especially during transport of the machine. For this reason, the driver's platform of the known embodiments has been arranged at the rear or the front of the machine which still offer enough space. This, in turn, entails the disadvantage that only one working direction can be visually observed to a really satisfactory extent.

Depending on the nature of the surface to be treated, the working process requires that the working drum axis be adapted with respect to the working depth, i.e. with respect to the relative vertical distance of the working drum axis for the to-be-treated surface and the absolute transverse inclination of the working drum axis. The tools arranged on the periphery of the working drum for performing the material detachment process are partly equipped with cutting tools known from road milling machines.

Depending on their respective type, the presently known methods and devices for the above described working process suffer from one or several of the following disadvantages:

The present solutions for the working drum drive, due to their hydraulic, hydraulic-mechanical or indirectly mechanical concepts, suffer from an unsatisfactory efficiency and corresponding energy losses. A direct mechanical drive has not yet been realized in the above machines.

Although an enlargement of the working space with increased working depth, offering favorable working results, has been realized in some embodiments of working machines, this has been accomplished only at the expense of the advantageous arrangement of the working drum axis relative to the drive carriage axes. This applies also to embodiments wherein, although the working drum axis is arranged between the drive carriage axes, the weight distribution (rear and resp. front axes) is so unfavorable that the above described advantage of using the machine weight for the pressing forces of the working drum cannot be utilized for the counter-rotational working process and the co-rotational working process. On the other hand, embodiments of working machines exist wherein the working drum axis is arranged in a favorable position relative to the drive carriage axes, but these machines do not offer the advantage of an enlargement of the working space with increased working depth.

In present embodiments of working machines, the outer cover is either fixedly or movably arranged on the supporting frame of the machine. In known working machines, the above described advantages of a fixed arrangement are only achieved if the working chamber is non-adjustable. Further, only in case of a fixed arrangement of the working drum housing, so-called breaker bars can be realized, since the fragmentation of material normally produces forces which advantageously are introduced into the machine frame. Adjustable breaker bars, i.e. devices wherein the distance between the breaker bar and the working drum during the working process can be changed, have not yet been realized.

In known working machines, the positioning of the driver's platform has not been satisfactory. Either, with a non-central arrangement, it is not possible to visually monitor the whole machine, or, with a central arrangement of the driver's platform and particularly in case of an embodiment comprising a driver's cabin, the transport height is so large that the transport from one construction site to another one requires a demounting of constructional components.

In the machines known up to now, the indication of the working depth is performed by reference to the relative position between the working drum axis and the drive carriage axis. For this reason, the largevolumed tires, which are frequently used in this type of working machines, will due to their resilient properties inevitably cause a measuring and indication error with respect to the working depth. The use of control devices for the adjustment and maintenance of a preselected working depth has not been realized yet.

Because of the partly high detachment resistance of the material to be worked on, incidents like e.g. the breakage of a cutting tool will cause damage to the holder or other constructional components fixedly attached to the working drum, which due to the resulting repair work will result in considerable operational disturbances and interruptions of the working process. The use of an exchange holder system which is known for so-called road milling machines, has not been considered yet for working machines of the type discussed here.

The above outlined state of the art is described, for instance, in the U.S. Pat. Nos. 5,259,692, 5,190,398 and 5,354,147.

SUMMARY OF THE INVENTION

Starting from a generic state of the art known from U.S. Pat. No. 5,259,692, it is an object of the invention to provide a machine for the refurbishing of roadways of the above type wherein optimum use can be made of the machine weight both in co-rotational operation and in counter-rotational operation.

The invention advantageously provides that a drive unit including the drive motor is supported in a pivoting frame and forms an assembly pivotable relative to the machine frame, that also the working drum is supported in said pivotable assembly and can be pivoted together with the assembly relative to the cover which is fixed in position on the machine frame, and that the working drum is directly acted on by the weight of the assembly, almost the complete machine weight being concentrated between the drive carriage axes and being transmitted to the pivotable assembly.

The arrangement of the drive unit on the pivotable assembly increases the weight acting immediately on the working drum, and the mass inertia of the assembly. Thus, the weight, which otherwise is distributed relatively uniformly between the drive carriage axes, is concentrated on the pivotable assembly arranged intermediate the drive carriage axes, so that the center of gravity is arranged in a low position and is equally advantageous for counter-rotational operation and co-rotational operation.

The adjustability of the working drum in combination with the pivotable assembly makes it possible to enlarge the size of the working space, e.g., with increasing working depth. Notably, depending on the set working depth, different material are available for mixing in the working chamber. The larger the preselected working depth, the larger the quantity of material which can be processed. Therefore, the working chamber used as a mixing chamber is variable, on the one hand for obtaining the desired throughput and, on the other hand, for obtaining the required high mixing quality at a high capacity.

The drive unit arranged in the pivotable frame comprises an internal combustion engine for generating the driving power for the working drum and the drive carriages. The internal combustion engine generates the overall driving power required for the operation of the machine, particularly the driving power for the working drum but also the driving power for the drive carriages. For this purpose, the drive unit can comprises a plurality of hydropumps, their hydraulic pressure being used for separate operation of hydromotors arranged in the wheels of the drive carriages.

Preferably, it is provided that the vertical reaction force of the cutting forces on the working drum in a co-rotational working process acts on the pivotable assembly by a lever arm which is of the same lenght or shorter than the lever arm by which the weight force acts on the pivotable assembly, whereby the working drum can be operated with the highest possible pressing force.

Particularly, it can be provided that the vertical plane of the resultant weight force substantially coincides with the vertical plane of the resultant reaction force of the cutting forces of the cutting tools of the working drum located in the engagement region in co-rotational operation.

In the above configuration, the working drum axis is arranged in a vertical plane extending at a horizontal distance 'a' from the common vertical plane of the resultant weight force and the resultant cutting forces.

By integrating the bearing means and the gear unit into the working drum as provided by the invention, the above described zero distance side is realized. In this manner, the working drum on one side of the machine can extend all the way to the driving lane in flush abutment thereon, so that a working process can be performed along a predetermined line. On this side, the projections protruding from the machine are so negligible that a working process can be performed along walls.

According to the invention, the low-loss transmission of the drive energy of the internal combustion engine is obtained in that the number of the drive components is minimized, and in that the arrangement of the components providing a direct flux of force is adapted to the spatial restrictions of the assembly.

According to the invention, the adjustment of the rotational speed of the working drum is performed by fixed transmission stages of a mechanical gear unit, by various adjustable transmission stages of a belt drive unit or by a combination thereof.

According to the invention, the enlargement of the working space with increased working depth is obtained by integrating the assembly into the machine frame provided with the outer cover fixedly attached on the machine frame. According to the invention, this makes it possible to arrange the working drum axis in such a manner between the drive carriage axes that optimum use can be made of the weight of the assembly comprising the machine and the working drum in order to generate possibly required pressing forces. The fixed connection of the outer cover to the machine frame as provided by the invention makes it possible to introduce the reaction forces from the fragmentation process directly into the machine frame, e.g. by a fixed arrangement of breaker bars on the outer cover, the breaker bars being pivotable about a pivot axis arranged in parallel to the working drum axis. In a particularly advantageous embodiment, the breaker bar is realized by and resp. functionally integrated into the material control valves of the outer cover, which normally are provided in such outer covers.

To obtain optimum working results, the position of the driver's platform is of outstanding importance. According to the invention, the driver's platform is arranged directly above the assembly including the working drum, i.e. largely in the central area of the machine. This allows for surveyability of the machine in a counter-rotational working process and a co-rotational working process. By the inventive principle of integrating the assembly including the working drum into the machine frame, the required constructional space (machine height) can be kept so small that, in spite of the central arrangement of the driver's platform, a minimum transport height can be obtained without demounting constructional components. In case that the working machine is to be provided with a closed driver's cabin, this is achieved according to the invention in that the upper portion of the closed driver's cabin is arranged to be pivoted for transport purposes. Further, due to this inventive arrangement of the driver's platform, the arrangement can be designed for transverse displacement relative to the machine frame to further improve the surveyability e.g. towards the so-called zero distance side.

By the inventive assembly including the working drum, the adjustment—required for the working process—of the transverse inclination of the working drum along with the constructional components for height adjustment of the machine frame, can be realized e.g. by means of column guides or parallelogram guides.

According to the invention, the indication of the working depth for both machine sides is obtained by relative measurement of the working depth between the machine frame and the surface to be worked on. This can be accomplished by contactless measuring systems as, e.g., ultrasonic sensors, provided as distance sensor, arranged laterally of the working drum axis or a plurality of ultrasonic sensors arranged laterally of the working drum axis. Instead of ultrasonic sensors, other contactless or contacting measuring systems can be used. An especially favorable embodiment of such systems is obtained if the measuring signal of these systems is used not only to indicate the working depth but also—by feedback of the signal—to control the working depth.

The working drum of the inventive machine is equipped with cutting tools. According to the invention, the connection between the cutting tools and the working drum is accomplished by a tool holder fixedly arranged on the working drum. The connection between the tool holder and the working drum is preferably a detachable connection. A particularly advantageous embodiment adapted for easy exchange is characterized by a tool holder which is attached to the working drum through a positive connection and additionally through clamping screws.

BRIEF DESCRIPTION OF THE DRAWINGS

Further features of the invention become evident from the following description of an embodiment of a machine according to the invention.

DETAILED DESCRIPTION

Figure 1:
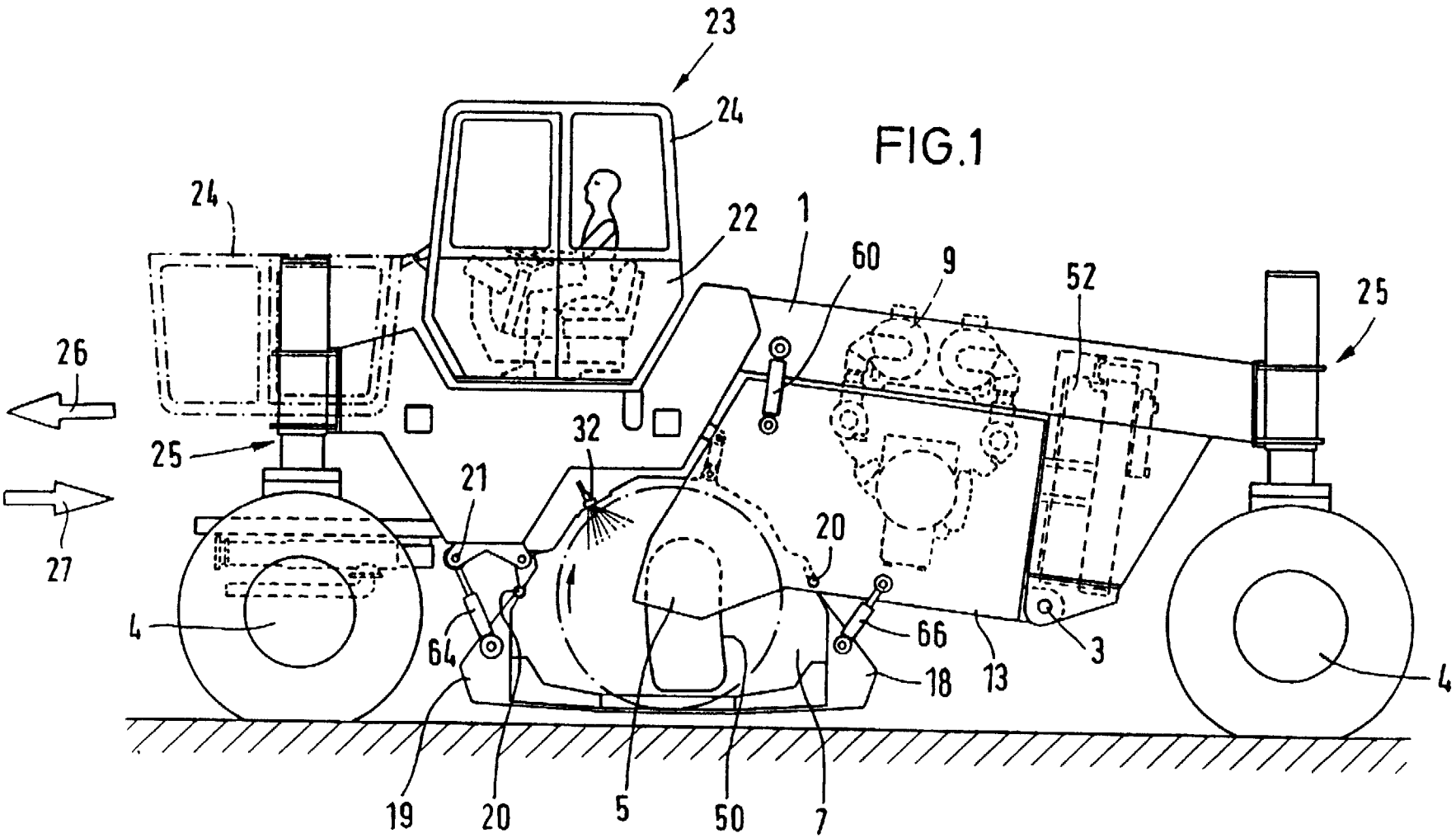
FIG. 1 is a schematic side view of the machine according to the invention.
Figure 2:
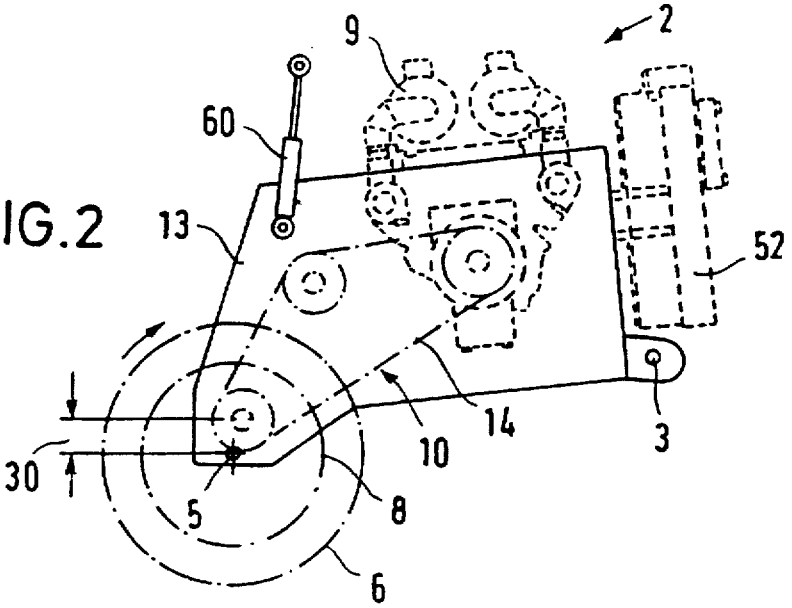
FIG. 2 is a schematic side view of the pivotable assembly.

FIG. 1 shows the machine for the treatment of roadways, comprising a machine frame 1 supported by two drive carriages and a driver's platform provided as a driver's cabin 23. The driver's cabin 23 can be displaced on the machine frame 1 transversely to the driving direction. The lateral hydraulic displaceability of the driver's platform provides the required visual surveyability when driving forward, be it during a working process or a high-speed transfer drive. Further, the driver's platform can be rotated by 180° for reverse movement, it being also possible in this case to change the steering axis 4 of the drive carriage. The driver's cabin comprises a lower portion 22 and an upper portion 24 which for transport purposes can be pivoted by 180° to reduce the constructional height of the machine and thus allow easier transport of the machine.

The drive carriages on the front and rear ends of machine frame 1 comprise two drive carriage axes 4 which can be steered in common or—if required—individually, each wheel being provided with an hydraulic drive means of its own, formed as a hydromotor, and being adapted to be driven separately, if required. Each wheel is provided with a height adjustment means 25 so that the height of the machine frame and—if required—its inclination can exactly adjusted to the working or transport height. Thus, the whole weight of the machine is concentrated in the region between the drive carriage axes 4. An outer cover 7 is fixedly attached below the driver's cabin at a displacement relative to the center of the machine, outer cover 7 delimiting a working chamber 28, serving as a mixing chamber, of a rotating working drum 8.

Below the machine frame 1, an assembly 2 is fastened to machine frame 1 to be pivoted about a pivot axis 3 extending in parallel to working drum 8, pivot axis 3 being arranged on the end of machine frame 1 opposite to the driver's cabin 23 substantially at the height of drive carriage axis 4. By means of piston-cylinder units 60, arranged on both sides of machine frame 1, the assembly 2 can be lowered to the required working depth 29, thus enlarging the working space 28 under the outer cover 7. The piston-cylinder units 60 are adapted for the application of force, on the one hand, substantially at the intermediate length of machine frame 1 and, on the other hand, at the end of assembly 2 facing towards working drum 8 in the upper region. Both force application points of each piston-cylinder unit 60 are arranged substantially in the vertical plane 41 of the center of gravity of the whole machine, said plane extending transversely to the driving direction.

The assembly 2 comprises a pivoting frame 13 supporting an internal combustion engine 9 with a cooling aggregate 52, hydropumps (not shown in greater detail) for the hydraulic drive means of the wheels, a belt drive 10 providing a direct mechanical drive for working drum 8 via a reduction gear 11, and the working drum 8 itself. Thus, a substantial portion of the machine weight is integrated in assembly 2 which therefore can transmit a high weight force immediately onto working drum 8. The rest of the weight force is transmitted from machine frame 1 to assembly 2 so that nearly the whole machine weight can be advantageously used for the co- or counterrotational working process.

The constructional design of the working drum drive in the assembly 2 safeguards the highest possible efficiency. The motor power of the internal combustion engine 9 is transmitted by a shifting coupling (not shown) and belt drive 10 directly onto reduction gear 11 in working drum 8. This drive unit integrated in assembly 2 offers the advantage that no hydraulic conversion with the resultant disadvantageous power loss need by performed, and that no bothersome power deviation need by provided. Instead, belt drive 10 permits a direct driving of reduction gear 11. Hydropumps for driving the wheels are driven by the internal combustion engine 9 via a pump distributor gear (not shown).

The favorable position of the working drum axis 5 of working drum 8 relative to the drive carriage axes 4 and the resultant advantageous weight distribution is evident from the Figures.

The outer cover 7, fixedly attached to machine frame 1, has the free ends of the cover housing provided with hydraulically adjustable valves 18,19 which are pivotable about pivot axes 20 extending in parallel to working drum axis 5. By use of an adjustable breaker bar, detached pieces of the road surface are milled into small particles, which is advantageous especially for cold recycling.

The valves 18,19 of outer cover 7 are used in the manner of an adjustable breaker bar for preventing excessive particle sizes, or in the manner of a material control valve, and are operated through hydraulic piston-cylinder-units 64,66. The pivot joint 21 for the hydraulic piston-cylinder-unit 64 is arranged in a lowered region of machine frame 1 below driver's cabin 23. The hydraulic piston-cylinderunit 66 for the material control valve 18 is pivoted to the assembly 2.

Figure 3:
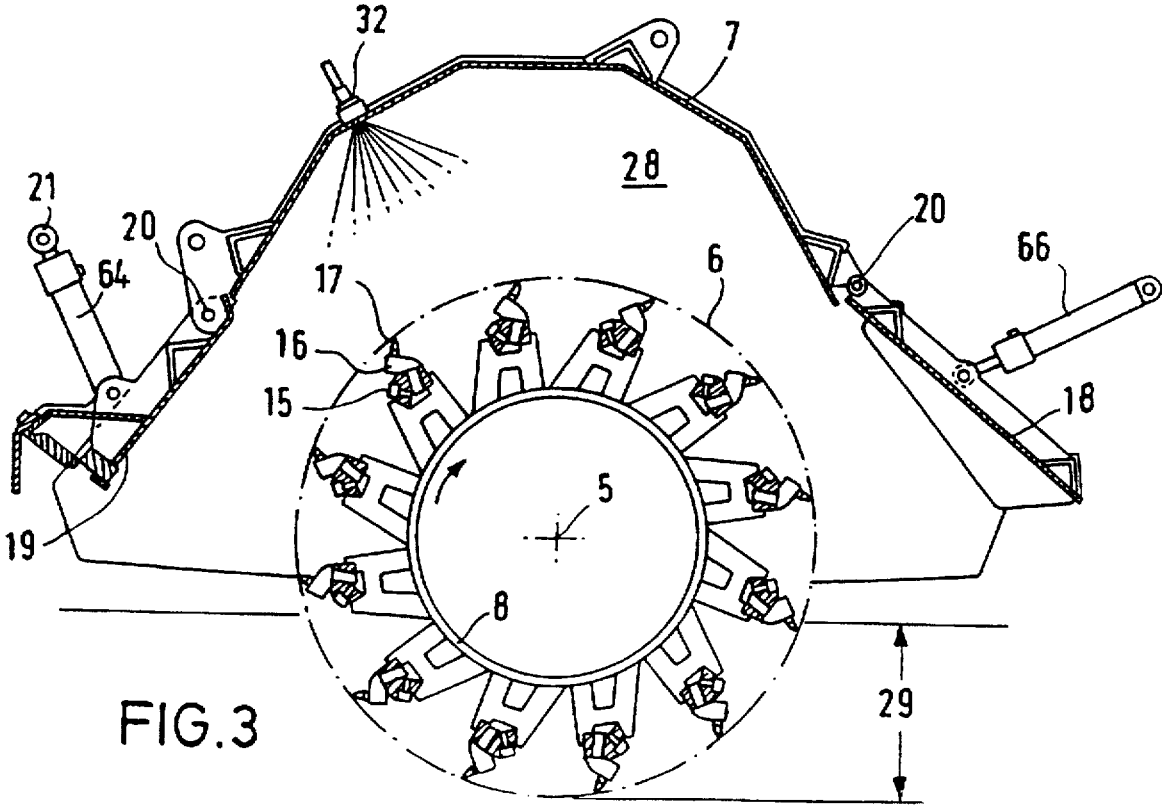
FIG. 3 is a view of the working drum in the working space defined by the outer cover.

As best shown in FIG. 3, outer cover 7 is provided with an applicator means 32 for a binding agent, so that the milled-off roadway material can be integrated again into the roadway—behind working drum 8 when viewed in the driving direction—in the form of a recycling material 62 provided with a binding agent (cement, lime, emulsion, bitumen).

The working drum 8 extends transversely to the driving direction over the whole width of the machine and on its periphery is provided with exchange holders 16 designed to receive cutting tools 17 and fastened by a clamping screw 15. Replaceable exchange holders 16 of this type allow for quick exchange in case of repair work and therefore shorten non-operative times. In the Figures, the cutting circle cylinder of the cutting tools 17 is designated by reference numeral 6. The sense of rotation 48 of working drum 8 is identical in counter-rotational operation and in co-rotational operation.

Figure 4:
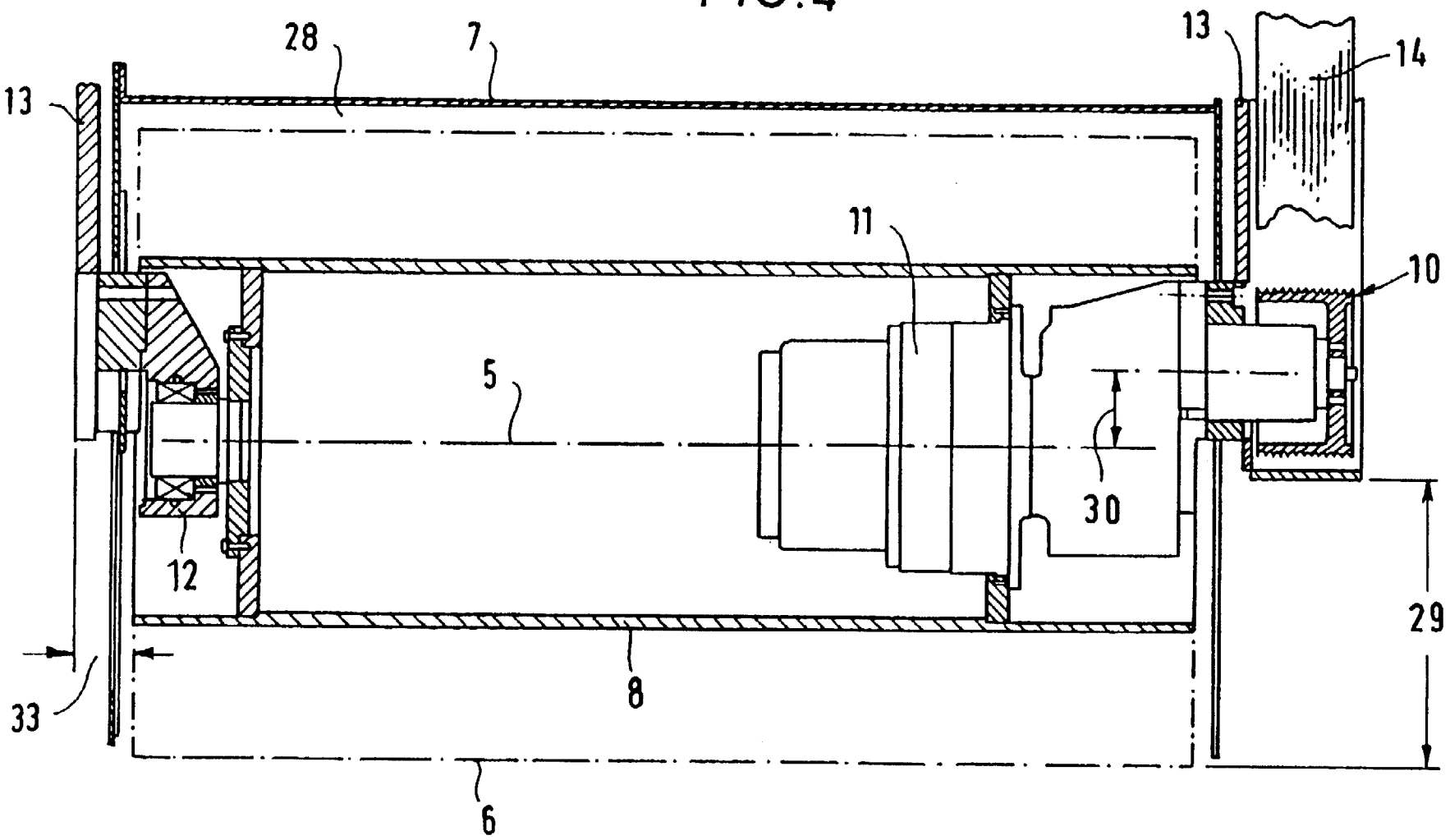
FIG. 4 is a schematic lengthwise sectional view of the working drum.

FIG. 4 shows a lengthwise sectional view of working drum 8, with the cutting circle cylinder 6 being indicated in chain-dotted lines. The working drum 8 is provided with a reduction gear 11 arranged within the working drum. For increasing the possible working depth 29 of working drum 8, reduction gear 11 is arranged at an axial displacement 30, so that the belt drive 10 on the side of the working drum has its rotational axis displaced in upward direction vertically to the working drum axis 5. The axial displacement 30 of the working drum drive means allows for an enlargement of the working depth 29 at the same drum diameter, or a reduction of the constructional size of working drum 8 at the same working depth 29.

The belt drive 10 provides for a direct force transmission from the internal combustion engine 9 to the reduction gear 11 by means of force belts 14.

As seen in FIG. 4, the pivoting frame 13 extends beyond the outer cover 7, and outer cover 7 has a recess 50 formed therein for allowing the working drum 8 to be lowered so that, with increasing working depth, also the working space 28 can be enlarged in an advantageous manner.

Depending on the set working depth, different quantities of material have to be mixed in the working chamber.

As likewise shown in FIG. 4, the interior bearing means 12 of the working drum 8 is arranged on the side opposite the reduction gear 11 in such a space-saving manner that, on this side of the working drum 8, a so-called zero-distance side is provided, allowing a treatment of the roadway almost without any parts of the machine projecting sideways. Thus, the distance of the outer cover of the machine to the working drum is reduced to the distance indicated by reference numeral 33.

Figure 5:
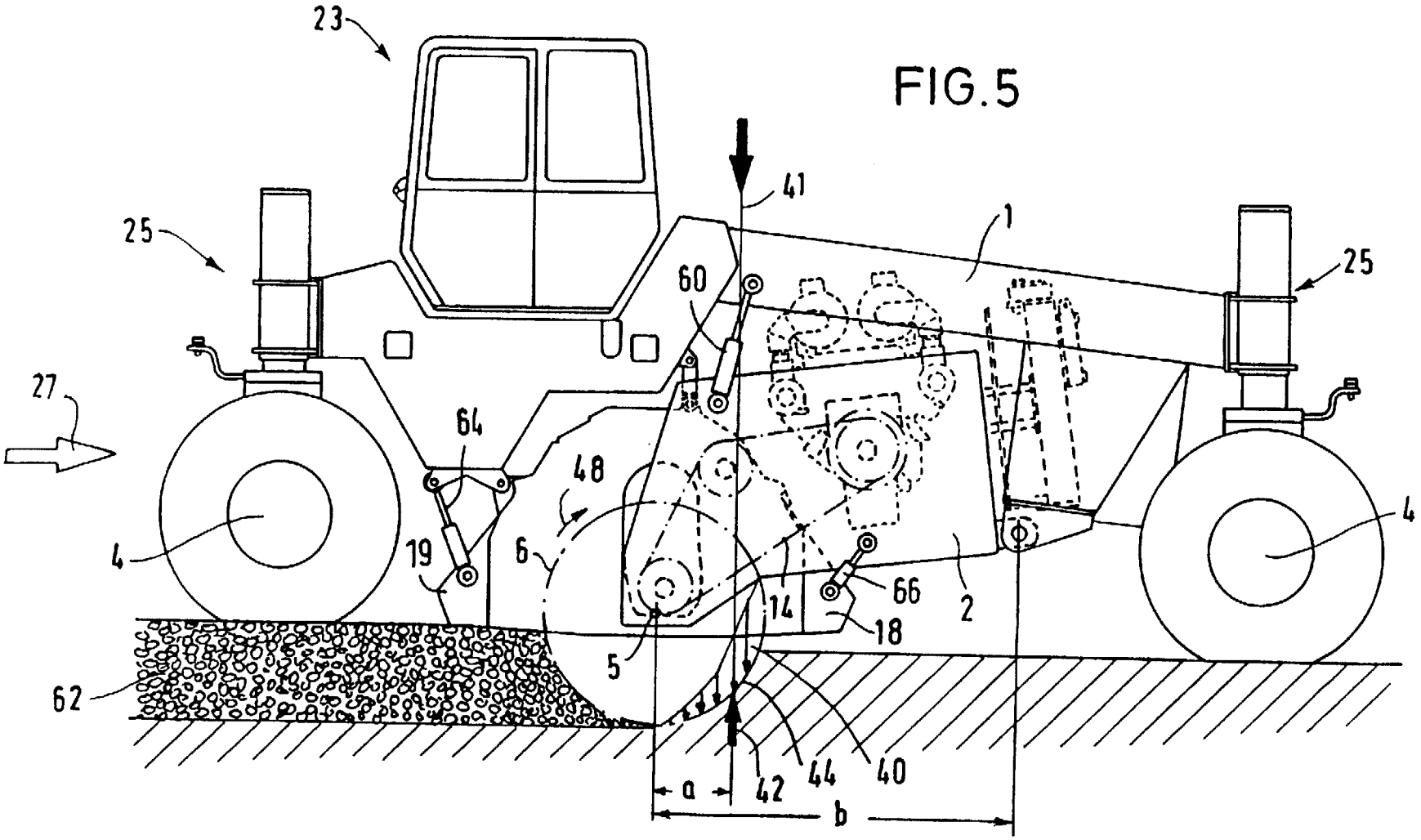
FIG. 5 is a view of the machine during co-rotational operation.

FIG. 5 illustrates the co-rotational working process. In the cutting circle cylinder 6, the vertical cutting forces substantially generated in the co-rotational working process and their cutting force distribution are indicated. These vertical cutting force components 40 in the region 44 of the engaged cylindrical outer surface allow conclusions on the resultant vertical force 42 exerting a reaction on the machine, extending at a distance 'a' to the working drum axis 5 and being opposed to the cutting forces 40. This resultant force is compensated by the weight force of the machine, it being required that the resultant weight force of the assembly 2 and of the machine frame 1 be arranged in the same vertical plane 41—extending transversely to the driving direction—as the vertical reaction force 42 resulting from the cutting forces. Thus, the machine is uniformly relieved by the reaction force 42 so that the driving behavior of the machine is not subjected to negative influences.

Figure 6:
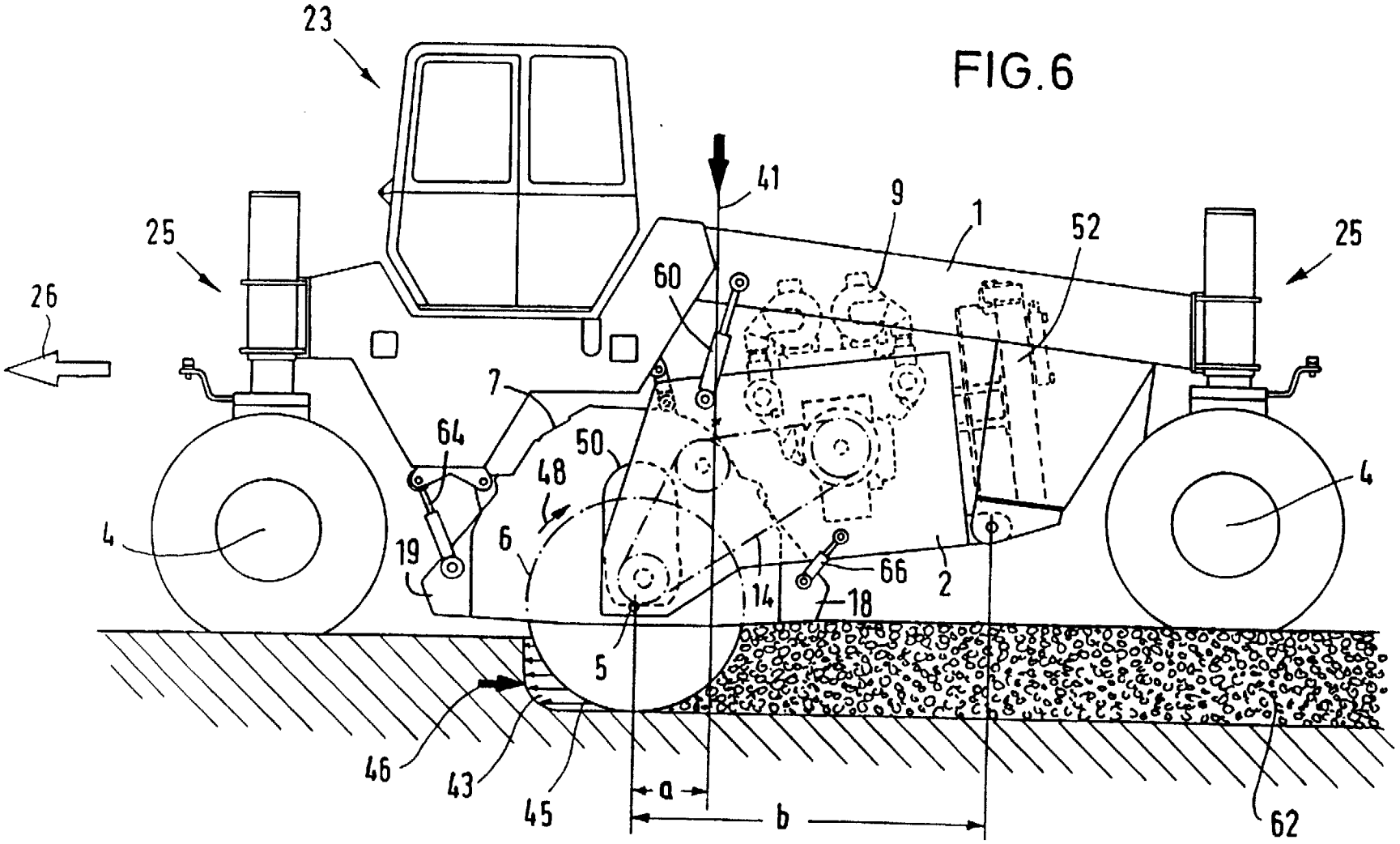
FIG. 6 is a view of the machine during counter-rotational operation.

In the counter-rotational working process illustrated in FIG. 6, horizontal forces 43 are generated in the engagement region 45 as relevant force components of the cutting forces, so that these forces have to be compensated substantially be the propulsive force 26 of the machine. The compensation force, indicated by reference numeral 46, is opposed to the propulsive force.

The horizontal distance 'a' of the working drum axis 5 of working drum 8 from the common vertical plane 41 is about 0.25 to 0.4 times, preferably about 0.3 times the diameter of the working drum. This distance allows for optimum use of the machine weight at a minimal distance of the drive carriage axes.

The distance 'b' of pivot axis 3 of assembly 2 from working drum axis 5 is at least 1.5 times up to twice the diameter of the working drum.

Since the machine in the longitudinal direction does not project beyond the drive carriages, the weight force can be introduced nearly completely into the pivotable assembly 2 which, due to the aggregates arranged therein, has already a high weight of its own which acts immediately on the working drum 8.

We claim:

1. A machine for the treatment of roadways, comprising a driver's platform for an operator, an automotive drive carriage having two drive carriage axes (4), and a working drum (8) supported to be pivoted relative to the machine frame (1) and surrounded by a cover (7) defining a working chamber with a working space between said working drum (8) and said cover (7), and a drive motor (9) generating the driving power required for driving the working drum (8), a drive unit including the drive motor (9) supported in a pivoting frame (13) and forming an assembly (2) pivotable relative to the machine frame (1), the working drum (8) being supported in said pivotable assembly (2) and the working drum (8) being pivotal together with the assembly (2) relative to the cover (7) which is fixed in position on the machine frame (1), thus allowing enlargement of the size of the working space of the working chamber with increasing working depth, and using the working chamber as a mixing chamber for obtaining a high mixing quality at a high process capacity, the working drum (8) big directly acted on by the weight of the assembly (2), almost the complete machine weight being concentrated between the drive carriage axes (4) and being transmitted to the pivotable assembly (2).

2. The machine according to claim 1, characterized in that the drive unit comprises an internal combustion engine (9) with a cooling aggregate (52), for generating the driving power for the working drum (8) and the drive carriages.

3. The machine according to claim 1 or 2, characterized in that the pivoting frame (13) is mounted on the machine frame (1) to be pivoted about an axis (3) extending in parallel to the working drum axis (5).

4. The machine according to any one of claims 1 or 2, characterized in that the working drum (8) is driven via a reduction gear (11).

5. The machine according to claim 4, characterized in that the drive for the reduction gear (11), performed via a pulley (10), is provided eccentrically of the working drum axis (5).

6. The machine according to any one of claims 1 or 2, characterized in that the assembly (2) pivoted to the machine frame (1) can be lowered via recesses (50) on an end side of the cover (7).

7. The machine according to any one of claims 1 or 2, characterized in that the cover (7) fixedly connected to the machine frame (1) is provided with breaker bars (19) pivotable about an axis arranged in parallel to the working drum axis (5) of the working drum (8).

8. The machine according to any one of claims 1 or 2, characterized in that the driver's platform comprises a driver's cabin (23), the wall elements of said cabin being completely or partly foldable for transport purposes.

9. The machine according to claim 8, characterized in that the upper portion (24) of the driver's cabin (23) is arranged to be pivoted for transport purposes.

10. The machine according to any one of claims 1 or 2, characterized in that contactless or contacting measuring systems are arranged on one or both machine sides for indicating the working depth (29).

11. The machine according to claim 10, characterized in that ultrasonic sensors are provided for indicating the working depth (29).

12. The machine according to claim 11, characterized in that the signals obtained from the sensors are used for controlling the working depth (29).

13. The machine according to any one of claims 1 or 2, characterized in that the working drum (8) is provided with cutting tools (17) held in exchange holders (16) by means of a positive connection.

14. The machine according to any one of claims 1 or 2, characterized in that the cover (7) has provided therein injection means (32) for bituminous and/or hydraulic binding agents.

15. The machine according to any one of claims 1 or 2, characterized in that the vertical reaction force of the cutting forces on the working drum (8) in a co-rotational working process acts on the pivotable assembly (2) by a lever arm which is of the same length or shorter than the lever arm by which the weight force acts on the pivotable assembly (2), whereby the working drum (8) can be operated with the highest possible pressing force.

16. The machine according to any one of claims 1 or 2, characterized in that the vertical plane (41) of the resultant weight force substantially coincides with the vertical plane of the resultant reaction force (42) of the cutting forces (40) of the cutting tools (17) of the working drum (8) located in the engagement region (44) in co-rotational operation.

17. The machine according to claim 16, characterized in that the working drum axis (5) is arranged in a vertical plane extending at a horizontal distance (a) from the common vertical plane (41) of the resultant weight force and the resultant cutting forces.

18. The machine according to claim 17, characterized in that said distance (a) is 0.25 to 0.40 times, preferably about 0.3 times the diameter of the working drum (8).

19. The machine according to any one of claims 1 or 2, characterized in that the distance (b) of the pivot axis (3) of the assembly (2) from the working drum axis (5) is at least 1½ times up to twice the diameter of the working drum (8).

* * * * *